US005367783A

United States Patent [19]

Nygren

[11] Patent Number: 5,367,783

[45] Date of Patent: Nov. 29, 1994

[54] LAYOUT TEMPLATE TOOL FOR POSITIONING BUILDING MATERIALS

[76] Inventor: Eric G. Nygren, P.O. Box 1082, 198 Alpine Dr., Nederland, Colo. 80466

[21] Appl. No.: 55,263

[22] Filed: Apr. 29, 1993

[51] Int. Cl.[5] ..... G01D 21/00

[52] U.S. Cl. ..... 33/613; 33/478; 33/520; 33/562

[58] Field of Search ..... 33/562, 613, 645, 520, 33/526, 501, 494, 427, 478

[56] References Cited

U.S. PATENT DOCUMENTS

| | | | |
|---|---|---|---|
| 1,665,400 | 4/1928 | Bittner | 33/501 |
| 2,659,980 | 11/1953 | Dunn | 33/520 |
| 3,015,164 | 1/1962 | Antell | 33/562 |
| 3,169,320 | 2/1965 | Currie | 33/613 |
| 3,724,085 | 4/1973 | Wentworth | 33/562 |
| 4,080,742 | 3/1978 | Osterried | 33/565 |
| 4,212,108 | 7/1980 | Jackson | 33/645 |
| 4,499,666 | 2/1985 | Smith | 33/494 |
| 4,527,337 | 7/1985 | Dreiling | 33/613 |
| 4,607,438 | 8/1986 | DeFrange | 33/562 |
| 4,882,846 | 11/1989 | Reed | 33/562 |
| 5,029,394 | 7/1991 | Carey | 33/197 |
| 5,083,380 | 1/1992 | Robertson | 33/562 |

*Primary Examiner*—Thomas B. Will
*Attorney, Agent, or Firm*—Duft, Graziano & Forest

[57] ABSTRACT

The layout tool is used for marking the positions for building materials, such as studs, joists, rafters, trusses and rough door opening trimmer studs, before nailing in permanent position on wall plates and sill plates. The layout tool has templates that are the same width of building materials, that are attached at indicia markings, "on center", from either end of an extruded member and the interlocking design of the manufacture keeps them perpendicular. Also provided are the rough door sizes that are indicia marked and layout can be marked from either end of invention.

6 Claims, 5 Drawing Sheets

LAYOUT TEMPLATE TOOL FOR POSITIONING BUILDING MATERIALS

BACKGROUND OF THE INVENTION

The conventional way of laying out wall studs, floor joists, roof rafters, trusses and rough door layout is time consuming and physically tiring and is not as accurate as using the apparatus of the present invention. The framing carpenter marks on a structural building member where the sides of all the interconnecting structural building materials are going to be placed using a tape measure. For 1½" wide wall studs, joists, rafters or trusses, the carpenter hooks the tape measure on the end of the wall plates or sill plate, he/she must deduct ¾" (½ the width of the material) at all center marks, on the tape measure and marks the wall plates, at standard engineered building centers, such as 15¼", 31¼", 47¼", etc. This is very eye straining and mistakes frequently happen in this process.

The other way of marking engineered building centers on a structural building member is to measure 15¼" along the length of the structural building member from the end of the plate and mark this point, then hammer a nail at that mark and bend it over perpendicular to the plates. The worker then hooks the end of the tape to the bent nail and pulls the tape out as the worker marks the engineered building centers and also make a "X" mark on both wall plates or sill plate on the side of the mark in the direction that the worker is going. After marking 20' of centers the carpenter tends to pull the tape measure and sometimes the nail will swivel and the centers are then wrong if he keeps marking to 30'. Then at 30' a nail is needed again at the last mark made. Layouts with tape measures are limited to the length of the tape measure before the nail system is needed. When all the centers are marked the carpenter must start at the beginning with a square and make square lines across the two plates or sill plate at all center marks made using the measurement process described above. These lines are where the side of the stud will be placed, on the "X" side.

Marking for joists and rafters is similar as the studs but marking for the plywood joist and rafters is more difficult because of the widths, 1¾" and 2 5/16" and the centers of 19.2" for these materials.

For rough door layout, the carpenter marks for a stud side, measures 1½" and marks, measures 1½" for door trimmer and marks and writes an "S" for the stud and a "T" for the trimmer. From that door trimmer edge, the carpenter measures the door size plus 2" for the jambs and shim spaces, then measures 1½" for the trimmer and marks and 1½" for the stud and marks, then writes the "T" and "X"s. The worker then uses a carpenter's square to mark perpendicular lines across the plates at the marks made using the tape measure to determine the proper engineered building centers. There are times when the carpenter forgets the 2" space or the individual does not know about the 2" space required for a door opening. This mistake, if not caught soon, can cost loss of time and expense as the building progresses. The present invention saves time, much bending and is accurate with no limit in layout length. There is no error of reading the tape measure or the person knowing dimensions or having to compute fractions of material sizes, such as one half of 1½", 1¾" or 2 5/16" and rough door size.

STATEMENT OF PRIOR ART

Hence, it has been proposed, as evidenced by U.S. Pat. No. 4,584,780 an electrical template, in U.S. Pat. No. 2,452,962 a beam centering tool and in U.S. Pat. No. 5,012,590 a disposable adhesive layout tape. The following foreign patent documents also do not anticipate the template tool of the present invention: No. 821 557 Fed. Rep. of Germany and No. 1.160.185 Rep. of France.

SUMMARY OF THE INVENTION

The present invention consists of an apparatus for marking on a structural building member, such as wall plates or sill plates, the correct position for interconnecting structural building members, such as studs, joists, rafters, trusses and rough door opening trimmer studs before they are permanently secured in place, on a building under construction. The manufacture of this invention is of less cost than raw building material, and has features that make it simple to use for error free marking of building structural members.

The layout tool of the present invention has templates that match widths of studs, joists, rafters and trusses, 1½", 1¾", 2 5/16" and are color coded to correspond to that width of building material. The templates include features that are of size and position to form an interlocking design to mate with the extruded guide member. The features that interlock the templates with the guide member, ensure that the templates and guide member are perpendicular to each other when attached. There are indicia marked holes drilled for correct spacing of templates to be attached with a fastener, bolt and nut, at desired centers, 12", 16" 19.2" (second center is indicia marked 38⅜") and 24". This invention will cut the time and physical backache by ⅜ rd's, and is the best for accuracy.

The layout tool of the present invention is first placed so the guide member end is flush with the end of wall plates or sill plate. Marking all template sides from that end, then moving invention so the end template is between the last marks made and mark templates again, etc.

The use of the different size templates for floor joists and rafters, is a similar procedure, except that the tool member is placed on the side of sill or rafter plate and templates are flat, on top of sill or rafter plates, for after marking templates there will be a outline of the building material to placed at that position.

Rough door layout is made by placing outer edge of the end template, commonly used 1½" wide, at inside edge of door trimmer line and mark correct door size for the other side trimmer stud edge, use end template to mark for trimmer and stud widths.

DETAILED DESCRIPTION

Figure 1:
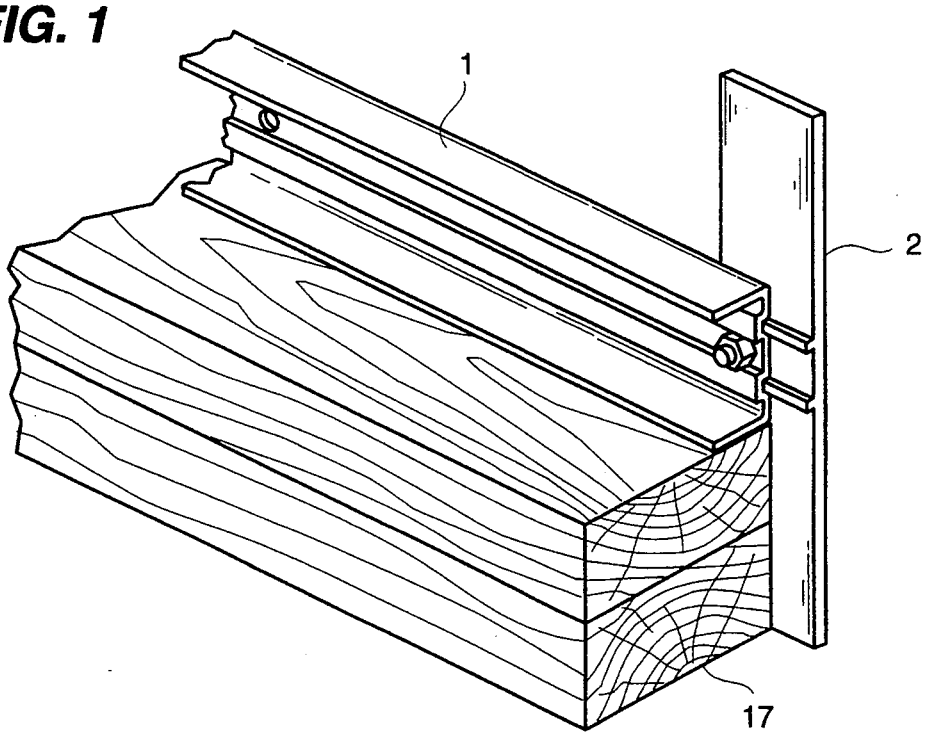
FIG. 1 illustrates a perspective rear view of the template tool of the present invention as placed in position on two wall plates.
Figure 2:
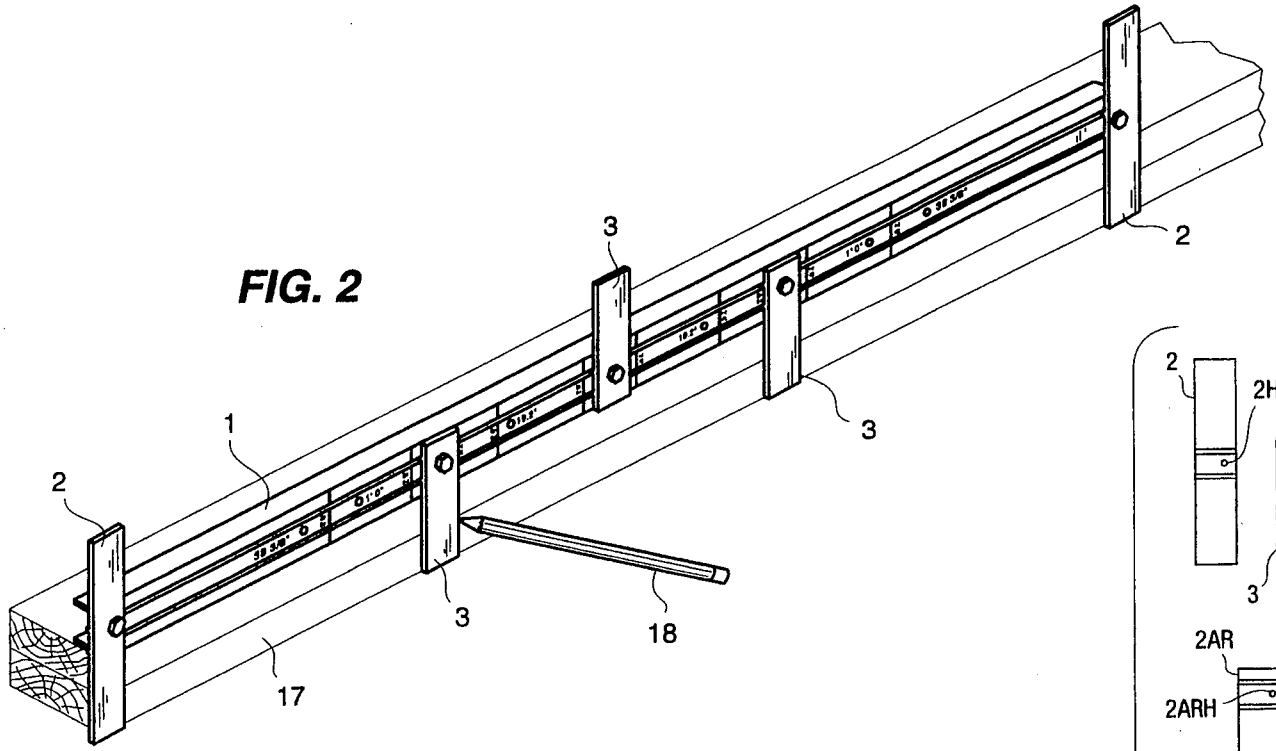
FIG. 2 illustrates a perspective front view of the template tool of the present invention as placed in position on two wall plates.

Reference is first made to FIG. 1 wherein the template tool of the present invention is placed on two wooden wall plates 17 that are laying flat, with the end of guide member 1 at end of wall plates 17. FIG. 2, illustrates a front view of the template tool, placed on two wall plates 17, with a plurality of templates 3 positioned to enable a carpenter marking to mark an outline of a structural building member (not shown) on wall plates 17 by marking around each of templates 3 with pencil 18 on wall plates 17. The outline of each template 3 is marked on wall plates 17 seriatim, in a direction from one end of wall plates 17 to a second end.

Figure 4:
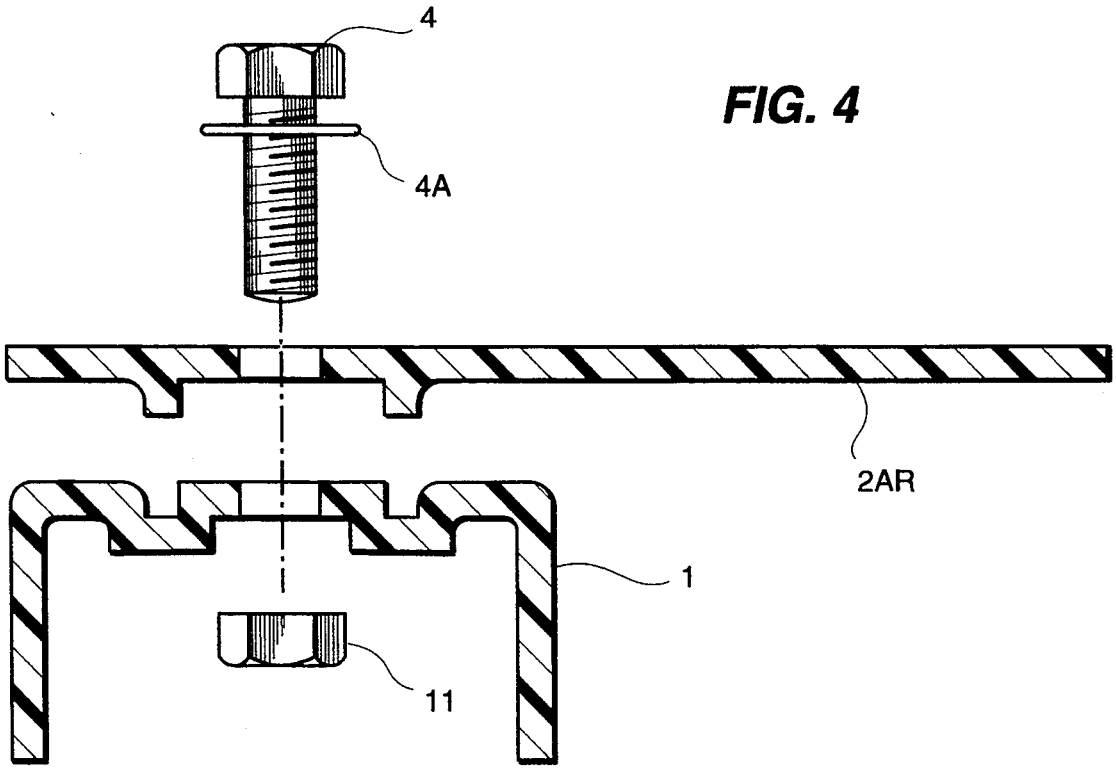
FIG. 4 illustrates an end exploded view of the template tool of the present invention to demonstrate the interlocking of templates and guide member.
Figure 5:
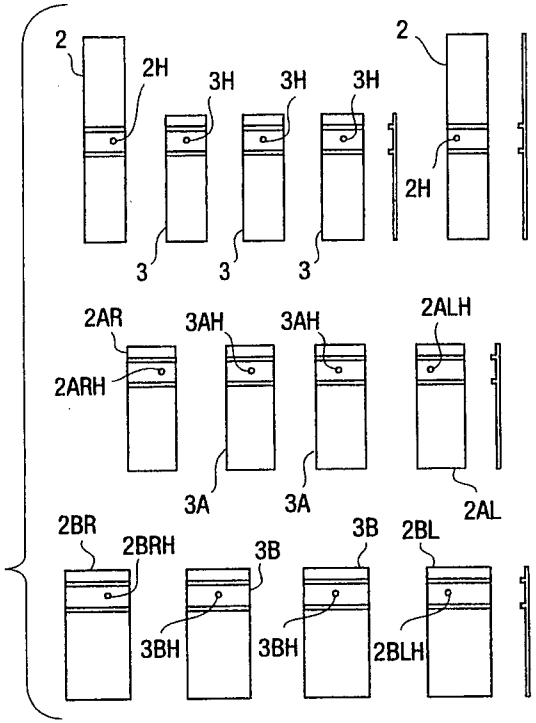
FIG. 5 illustrates rear and side views of a plurality of different size templates.
Figure 3:
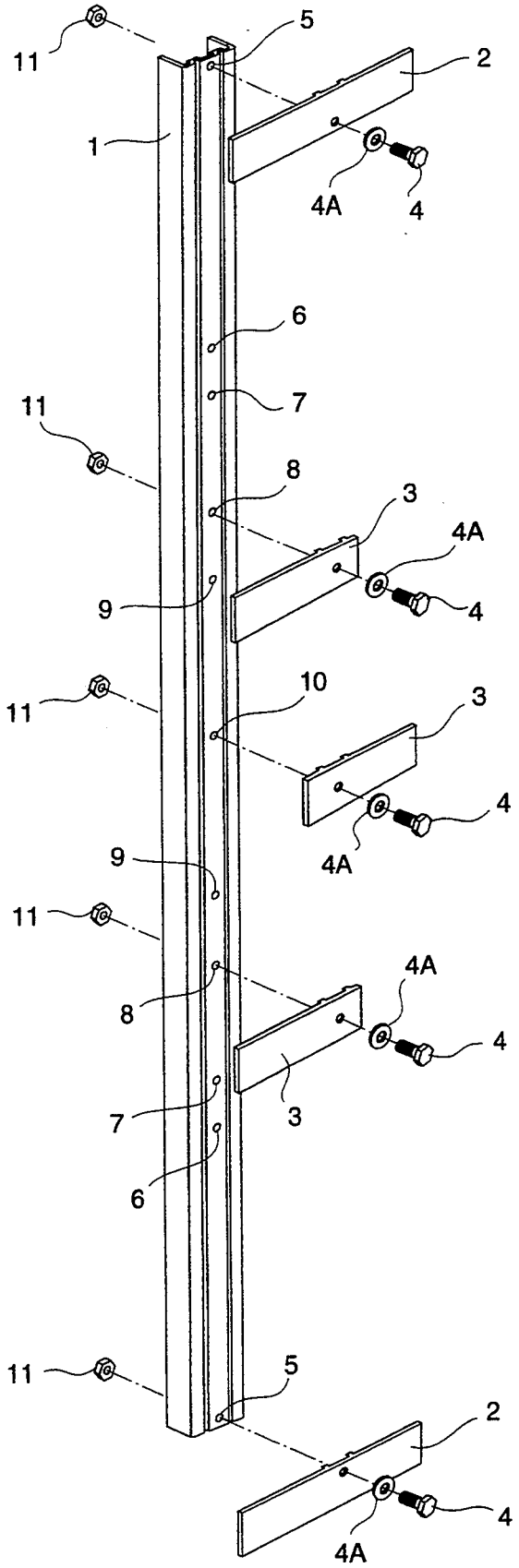
FIG. 3 illustrates a perspective exploded view of the template tool of the present invention.

Reference is made to FIG. 3, which is an exploded view of the template tool of the present invention, with a guide member 1 and templates 2, 3 and a fastener consisting of: bolt 4, washer 4A and nut 11. Guide member 1 consists of a straight ridged material of extruded plastic or other ridged material at a length that will be a multiple of 2, or 16. FIG. 4 and FIG. 5 illustrate side and rear views of various dimensioned templates 2*, 3* manufactured by injection or extruded plastic or other ridged material, which can be color coded for simplicity of different size determination. The design of the extrusion pattern for templates 2, 3, 2AR, 3A, 2AL, 2BR, 3B and 2BL and the design of the extrusion of guide member 1, are such that the templates 2*, 3* and guide member 1 are interlocking when the templates 2*, 3* are attached to guide member 1. FIG. 4 illustrates a side view of a typical extrusion pattern, with two indentations in guide member 1, deep enough to accept the mating protrusions of templates, such as template 2AR, keeping templates perpendicular to guide member 1 and secured when fastened. The extrusion form, on backside of the guide member 1 keeps nut 11 unable to move when bolt 4 is tightened.

Figure 6:
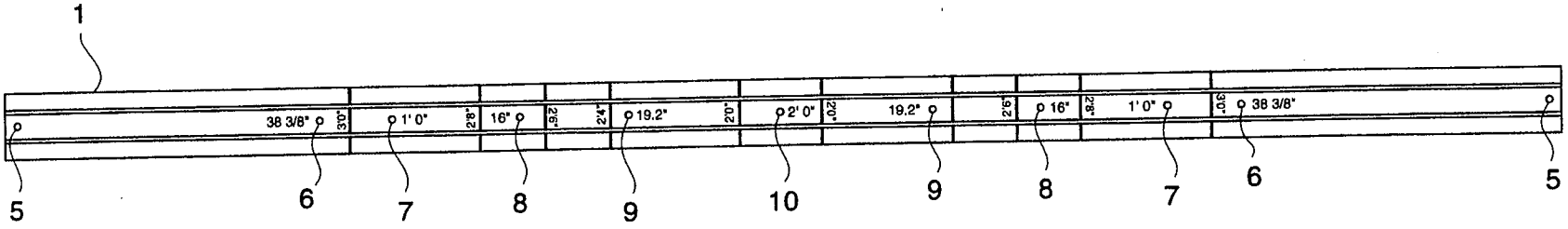
FIG. 6 illustrates a front view of the guide member with its imprinted indicia markings.
Figure 7:
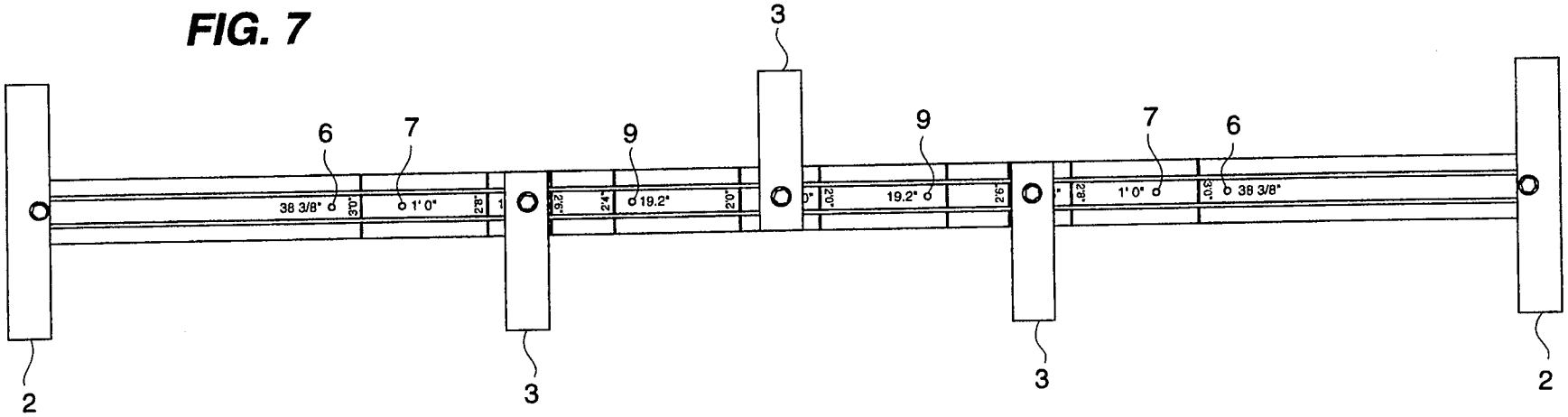
FIG. 7 illustrates a front view of the template tool of the present invention with a number of templates installed thereon.

Reference is made to FIG. 5. The width of templates is the width of building materials that are used in the building process, such as: studs, floor joists and rafters. Templates 2 and 3 are, for example, 1½" wide, while templates 2AR, 3A, 2AL are 1¾" wide and templates 2BR, 3B, 2BL are 2 5/16" wide, at a thickness so a marking device rides along the sides of the template edge from guide member 1 to end of template, which length is just less than the height (3") of two wall plates 17 lying flat. FIG. 6 and FIG. 7 illustrate guide member 1 and guide member 1 with templates 2, 3 interlocked, respectively. Templates 2 are positioned at both ends of guide member 1 and building structural member templates 2 are centered widthwise on guide member 1. Along the length of guide member 1 is formed a plurality of apertures or holes 5, centered between the extrusion indentations on guide member or one half the width of guide member 1. FIG. 5 illustrates the mating holes 2H, 2ARH, 2ARLH, 2BRH and 2BLH in template 2, 2AR, 2AL, 2BR, 2BL which holes coincide with the holes 5 on guide member 1 when templates 2*, 3* are attached to guide member 1. All end templates, 2, 2AR (R for right template), 2AL (L for left template), 2BR, and 2BL are centered in width, at the end of guide member 1, where the holes in guide member 1 and end templates 2AR, 2AL coincide. Templates 3, 3A and 3B have a hole at the center of the width and centered between the protrusions of the extrusion of guide member 1, which is one half of guide member 1 width, which will coincide with holes in guide member 1.

Reference is made to FIG. 6 and FIG. 7, wherein the indicia markings placed on guide member 1, are to show the placement positions for the templates. The indicia markings are placed next to a hole, centered in width on guide member 1, at the proper distance of that indicia number from either end of guide member 1. The indicia marked hole centers are the engineered distances for building materials, as the indicia markings 1'0", 16", 19.2", 38⅜" (a second 19.2" center) and 2'0".

FIG. 6 and FIG. 7 illustrate templates 3 placed on guide member 1 at coinciding holes 8, with corresponding indicia marked at 16" and also noted at a 180 degrees position at coinciding hole 10. The Figures also illustrate indicia marked at a location that corresponds to 2'0" from the end of guide member 1, and templates 2 attached at coinciding holes 5 of guide member 1, the centers of the templates being located at the indicia marking 16", "on center", on one side, and 24", "on center" on the other side of the guide member. This positioning of these templates of 1½" width, at these positions are the most commonly used in the construction trade. Templates, (not shown), 3 can be placed in various combinations, listed below. These combinations include templates 3 oriented in the same direction at holes 8 and hole 10, which is centered at 8" spacing. Templates 2AR and 2AL centered on ends, at coinciding holes 5 placed in same direction, (not shown), on guide member 1 with templates 3A at coinciding holes 8, corresponding to indicia markings 16" are 16" "on center". When one template 3A is attached at coinciding hole 10 at indicia marking 2'0", the centers are 2'0", "on center". With, (not shown), one template 2AR or 2AL attached at coinciding hole 5 and a 3A template attached at coinciding indicia marked hole 19.2" (hole 9) and a template 3A attached at coinciding indicia marked hole 38⅜" (hole 6), the centers are as the indicia marking 19.2" (38⅜" is the second center of 19.2") "on center". This engineered "on center" dimension is for the plywood joist and rafter systems. With (not shown) templates 2BR and 2BL centered at coinciding hole 5 of guide member 1 and templates 3B placed over coinciding hole 7 at indicia marking 1'0", the centers are as the indicia marking, 1'0", "on center", for plywood joists and rafter systems, 2 5/16" wide.

Figure 8:
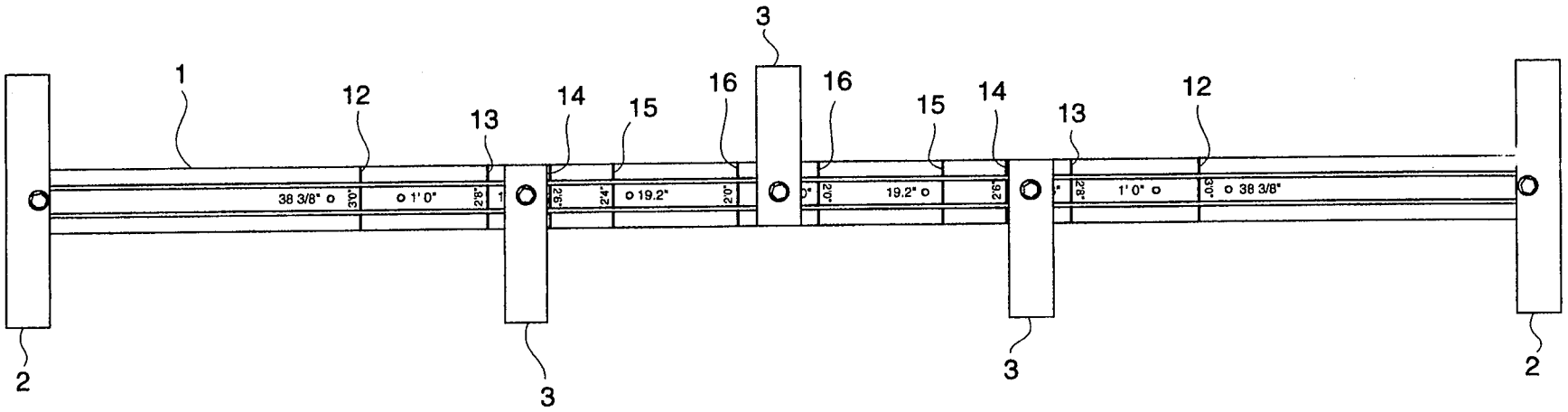
FIG. 8 illustrates the template tool of the present invention with templates installed for the purpose of rough door indicia marking.

Reference is made to FIG. 8, which illustrates an application for rough door sizes, wherein indicia marked lines that are perpendicular to guide member 1 edge and are at a distance from outside edge of template 2 to the indicia line, which is 2" larger than a door size. Next to and parallel to that line, is imprinted on guide member 1 an indicia number showing door size, indicia 16 at a location that corresponds to 2'0", indicia 15 at a location that corresponds to 2'4", indicia 14 at a location that corresponds to 2'6", indicia 13 at a location that corresponds to 2'8" and indicia 12 at a location that corresponds to 3'0".

What is claimed is:

1. A layout template tool for marking first structural building members to position other structural building members such as floor joists, studs, rafters and rough door opening trimmer studs, in relation to said first structural building member comprising:

a guide member manufactured of an extruded material, having a length and a width and having a plurality of apertures formed therein, spaced apart along said length at sites representative of engineered building centers for said other structural building members;

a plurality of templates, each of which includes an aperture formed therein and having features that interlock with features on said extruded material of said guide member, said features comprising an interlocking track and groove combination, to maintain said template perpendicular to said length of said guide member and extending beyond said width of said guide member when fastened to said guide member with a fastener, each said template having a width that corresponds to a building member width to function as a guide for a marking device, to draw an outline of that building member on said structural first building member when said guide member is placed lengthwise against said first structural building member, and wherein said template, when rotated 180 degrees with respect to said guide member, still interlocks with and is maintained perpendicular to said guide member.

2. A layout template tool according to claim 1, wherein said guide member is of length that is substantially a multiple of a length of an engineered building center and includes indicia imprinted on said guide member adjacent each said aperture, said indicia noting a distance of said aperture from an end of said guide member for placement of templates.

3. A layout template tool according to claim 2, wherein each of said templates have an aperture formed therein that coincides with said apertures formed in said guide member to position said template when fastened to said guide member on center from each other, and from either end of said length of said guide member.

4. A layout template tool according to claim 3, wherein said templates are of length to extend beyond a lengthwise edge of said guide member a distance less than but not equal to, two wooden wall plates, placed flat in width.

5. A layout template tool according to claim 1, wherein each said template is color coded to correspond to different size building members.

6. A layout template tool according to claim 1, wherein said guide member includes indicia imprinted thereon indicative of door sizes and an indicia line, placed on said guide member a distance from an outside edge of a commonly used template said distance being a rough door distance, to include that door width, jamb thicknesses and shim space size.

* * * * *